United States Patent [19]

Schmid

[11] Patent Number: 4,637,363

[45] Date of Patent: Jan. 20, 1987

[54] MULTI-CYLINDER INTERNAL-COMBUSTION ENGINE CONTROL DEVICE

[75] Inventor: Wolfgang Schmid, Markgröningen, Fed. Rep. of Germany

[73] Assignee: Porsche Aktiengesellschaft, Fed. Rep. of Germany

[21] Appl. No.: 706,449

[22] Filed: Feb. 27, 1985

[30] Foreign Application Priority Data

Feb. 27, 1984 [DE] Fed. Rep. of Germany ..... 3407000

[51] Int. Cl.[4] ..... F02D 17/02

[52] U.S. Cl. ..... 123/481; 123/580; 123/198 F

[58] Field of Search ..... 123/198 F, 580, 581, 123/481

[56] References Cited

U.S. PATENT DOCUMENTS 2,623,617 12/1952 Snyder et al. ..... 123/198 F
4,257,371 3/1981 Ishida ..... 123/198 F
4,296,719 10/1981 Takahashi et al. ..... 123/198 F
4,305,249 12/1981 Schmid et al. ..... 123/198 F
4,393,827 7/1983 Schmid ..... 123/198 F
4,484,548 11/1984 Sugasawa et al. ..... 123/198 F
4,485,776 12/1984 Mokuya et al. ..... 123/198 F

*Primary Examiner*—Ira S. Lazarus
*Attorney, Agent, or Firm*—Barnes & Thornburg

[57] ABSTRACT

An internal-combustion engine which includes two cylinder groups, of which one cylinder group operates constantly, whereas the second cylinder group is inactive in a part-load operation for better fuel economy. However, during forward or reverse operation of the vehicle and during the warm-up phase of the internal-combustion engine, the second cylinder group is provided with a reduced fuel-air mixture to prevent the engine from dying. An actuating device is provided which responds to certain parameters such as engine temperature and gear position. This actuating device controls a radial cam which interacts with the throttle valve for the second set of cylinders during these conditions to supply the required fuel-air mixture.

19 Claims, 4 Drawing Figures

MULTI-CYLINDER INTERNAL-COMBUSTION ENGINE CONTROL DEVICE

BACKGROUND AND SUMMARY OF THE INVENTION

This invention relates to a multi-cylinder internal-combustion engine having two cylinder groups, the engine being used to power a motor vehicle. More particularly, the invention relates to a control device which allows one group of cylinders to be switched off during certain phases of operation to provide greater fuel economy.

On the basis of German Patent Publication DE-OS No. 29 97 934, an internal-combustion engine of the type according to the present invention is known where in the warmed-up condition, the switching-on and switching-off of the second group of cylinders takes place essentially without jerking. However, in that application, the warming-up phase of the internal-combustion engine is not taken into account.

Furthermore, according to German Patent Publication DE-AS No. 11 09 947, a multi-cylinder internal-combustion engine is known where individual or all cylinder groups receive fuel, according to the torque requirement, and which runs with all cylinders in the warming-up phase of all operational ranges. This Publication does not contain any reference to the fact that the feeding of the fuel-air mixture to the individual cylinders of the individual cylinder groups differs as a function of the load on the internal-combustion engine.

According to the publication "Possibility of Saving Fuel by Switching Off Cylinders," Schellmann et al, 1st Int. Automotive Fuel Economy Research Conference, Oct. 31–Nov. 1, 1979, an internal-combustion engine is known having two cylinder groups, each cylinder group having one throttle valve assigned that is located in an intake pipe. The position of the throttle valve can be changed by the gas pedal via a cam plate, the cam plate interacting with control levers that are arranged on the throttle valve shafts so that they are fixed with respect to rotation.

On the basis of Japanese Pat. No. 557 913, a six-cylinder internal-combustion engine is known, whose cylinders 1 thru 3 are switched off at low load. The internal-combustion engine includes an electronic device which, in the case of low temperatures, is influenced via a signal transmitter.

In addition in U.S. Pat. No. 4,153,053, shows a system for switching off some cylinders of a multi-cylinder internal-combustion engine where the switching-off of the cylinders takes place at low load. However, all cylinders are active during the warming-up phase.

Finally, according to German Patent DE-PS No. 30 44 248, a multi-cylinder internal-combustion engine is known having two cylinder groups, of which, when the internal-combustion engine is warmed-up, one cylinder group is inactive over a predetermined part-load range. The other group of cylinders operates normally. When the internal-combustion engine is cold, a control lever of the throttle valve of the usually inactive group of cylinders interacts with a cam range of a cam plate in such a way that this cylinder group also receives the fuel-air mixture. As a result, the starting of a vehicle having this internal-combustion engine is improved. However, because of the cam plate kinematics for the switching-off operation, the feeding of the fuel-air mixture is sharply reduced at the end of the predetermined part-load range which causes a reduction of torque which may result in the dying of the internal-combustion engine.

It is therefore the objective of the present invention to provide an internal-combustion engine which can be installed into a motor vehicle so that during the starting process of this vehicle, as well as in the warming-up phase of the internal-combustion engine, a sufficient torque is always made available by having both cylinder groups operate. During other phases of operation one group of cylinders may be switched off to provide greater fuel economy.

According to the present invention, an internal-combustion engine is provided such that when the vehicle is moving, in either forward or reverse, during the warm-up phase of the internal-combustion engine, and if necessary, as a function of a manually operable transmitting means or switch, both cylinder groups are activated in such a way that good operational characteristics, i.e. sufficient torque and no dying of the internal-combustion engine, are ensured over a predetermined part-load range. This is achieved by means of the radial cam and an actuating device which interact via the relaying of two bent levers constructed as a transmission rod structure. The radial cam, because it is disk-shaped and narrow, is easy to manufacture and can be mounted simply on the cam plate. The vacuum box of the actuating device can advantageously be influenced by a magnetic valve which is fitted into a vacuum pipe connected with the intake pipe, the magnetic valve receiving signals from an existing injection control device.

Further objects, features, and advantages of the present invention will become more apparent from the following description when taken with the accompanying drawings which show, for purposes of illustration only, an embodiment in accordance with the present invention.

DETAILED DESCRIPTION OF THE DRAWINGS

Figure 1:
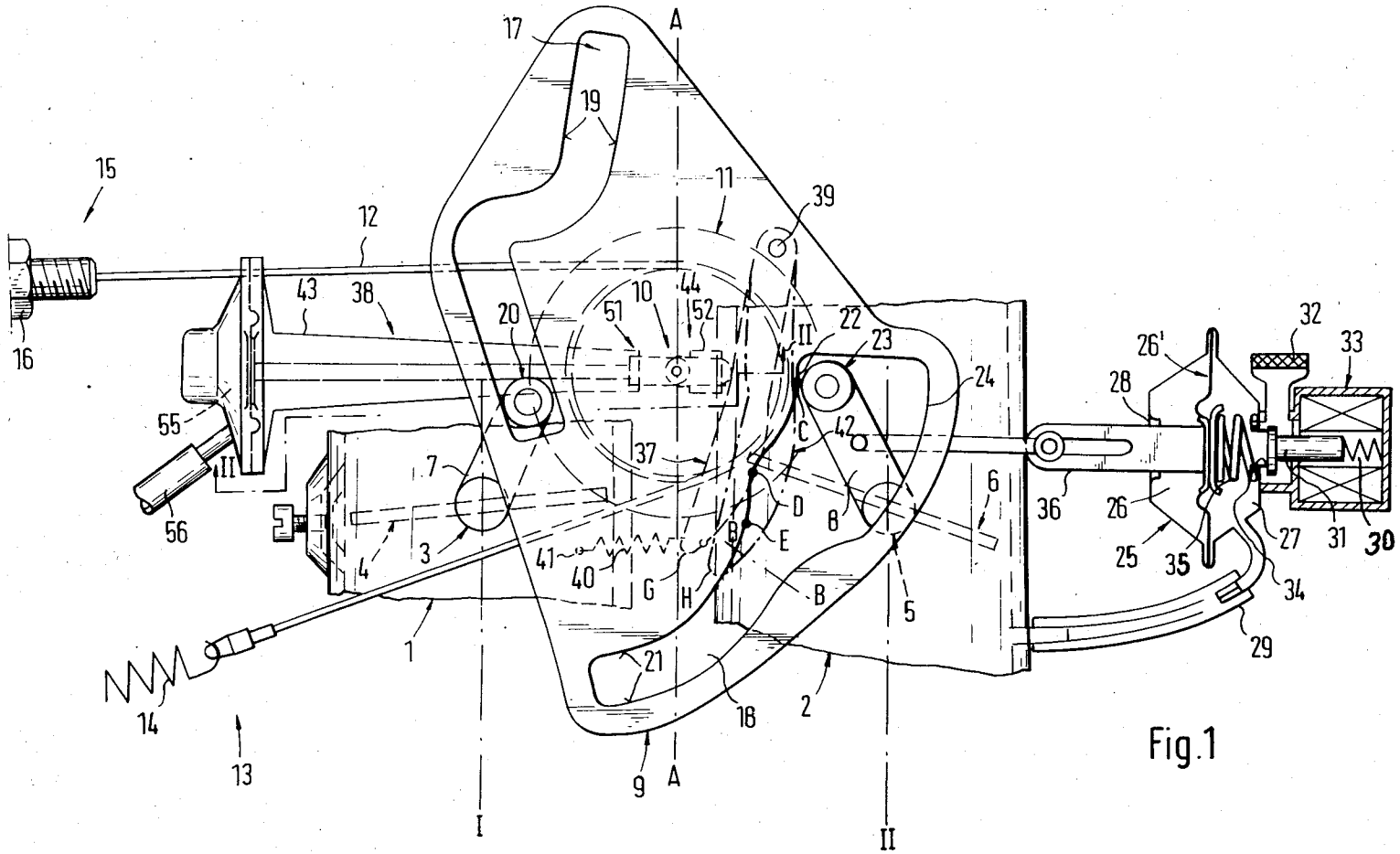
FIG. 1 shows the control system of throttle valves of an internal-combustion engine having two groups of cylinders.

In FIG. 1, an intake pipe 1 is assigned to the first cylinder group I, and an intake pipe 2 is assigned to the second cylinder group II. These are components of an internal-combustion engine that is not shown in detail. In intake pipe 1, a throttle valve 4 is arranged on a shaft 3, and in intake pipe 2, a throttle valve 6 is arranged on a shaft 5. The throttle valves 4 and 6 are connected with the shafts 3 and 5 such that the throttle valves are fixed with respect to rotation of the shafts. In addition, the shafts 3 and 5 have control levers 7 and 8 attached which interact with a cam plate 9.

Cam plate 9 pivots about an axis extending through reference point 10, the axis being perpendicular to line A—A. Cam plate 9 has a deflection pulley 11 which is partially engaged by a throttle cable 12. At reference point 13, the throttle cable 12 is provided with a pullback spring 14, and at reference point 15, it is provided with an adjusting device 16 to which a gas pedal is connected that is not shown.

The cam plate 9 includes a first slot 17 and a second slot 18. The first slot 17 has a curved path which in all operational ranges (idling, part-load, full-load), including the warming-up and warmed-up phases of an internal-combustion engine, contacts a sliding element 20 on the control lever 7. The second slot 18 is provided with a curved path 21 having a parallel course approximately to the line B—B. After that, the inside section 22 of the path is shaped in such a way that the control lever 8, with the insertion of a sliding element 23, is moved from a slightly open position (point C in the path) to a closed position (point D in the path) and subsequently back to an open position (starting at point E in the path).

The other opposite and therefore outside section (24) of the path delimits the open position of the throttle valve (6) during the switching-off operation of the second cylinder group II, i.e., when this group is not fired.

A vacuum box 25 having an upper chamber 26 and a lower chamber 27 is connected with the control level 8 of the second cylinder group II. Both chambers are separated from one another by means of a membrane 26'. The upper chamber 26 is connected with the atmosphere by means of an opening 28. In contrast, the lower chamber 27 is connected to the intake pipe 2 via a control pipe 29. In addition, the lower chamber 27 is in contact with an electromagnetic ventilation valve 33 having a pressure spring 30, a valve stem 31, and a ventilation opening 32. The ventilation valve 33, by means of the valve stem 31, controlling the flow-through cross-section of a discharge opening 34 of the lower chamber 27. On the side of the lower chamber 27, the membrane 26', is acted upon by a pressure spring 35, and on the side of the upper chamber 26, this membrane 26' is connected with a control lever 8 via a rod system 36.

Figure 2:
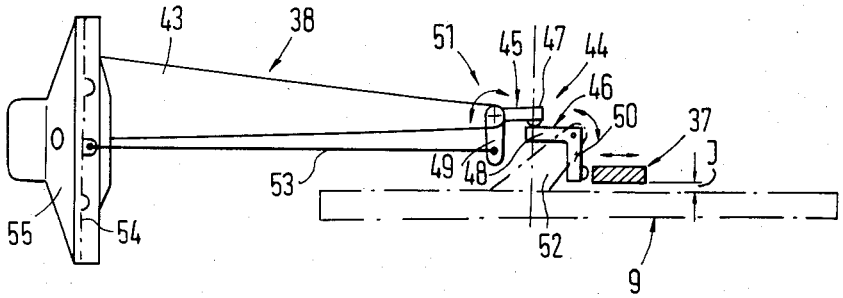
FIG. 2 shows a section according to the line II—II of FIG. 1.

In operation, the internal-combustion engine supplies sufficient torque when the vehicle is operating in either forward or reverse in the warm-up phase of the engine, because cylinder groups I and II are both fired as a function of the position of the gears and the engine temperature. In other words, the cylinder group II which is inactive when the internal-combustion engine is warmed up, is in operation. For this purpose, a radial cam 37 is provided at the cam plate 9, said radial cam 37, by means of an actuating device 38, being movable from a rest position G to an operational position H. The radial cam 37 is shaped like an oblong disk having a flat rectangular cross-section and is located a fixed distance J from the cam plate (FIG. 2). In addition, the radial cam 37, at one end, is pivoted around a bearing journal 39 extending vertically with respect to the cam plate 9. A tension spring 40 is attached to the opposite end of radial cam 37 for the purpose of yieldably urging the radial cam 37 into the rest position G. The tension spring 40 is fastened at point 42 to the cam plate 9. In the operational position H, the radial cam 37, having a cam contour line 42, projects beyond the section 22 of the path of the slot 18, the sliding element 23 of the control lever 8 being moved along this cam contour line 42. As a result, the throttle valve 6 is opened.

The actuating device 38 includes a vacuum box 43 and a transmission rod structure 44. The transmission rod structure 44 acts between the vacuum box 43 and the radial cam 37 and is formed by two bent levers 45, 46 (FIG. 2). The bent levers have horizontal legs 47, 48 and vertical legs 49, 50. The vertical and horizontal legs of each lever are arranged at a right angle with respect to one another.

Figure 3:
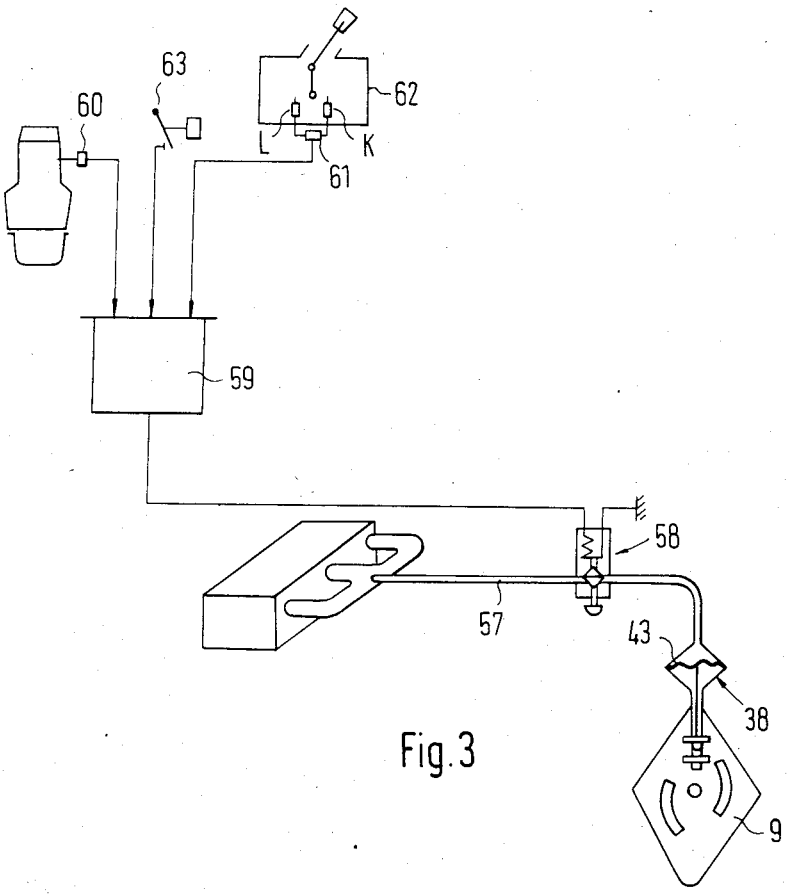
FIG. 3 shows a switching diagram for the control of an actuating device according to the invention.

At reference point 51, bent lever 45 is movably attached to the vacuum box 43, whereas bent lever 46 is movably attached to cam plate 9 by arm 52. The horizontal legs 47, 48 are arranged above one another and touch one another. The vertical leg 50 of the bent lever 46 interacts with the radial cam 37. The other vertical leg 49, via a rod structure 53, is connected with a membrane 54 of the vacuum box 43. Vacuum box 43, with a vacuum chamber 55, is connected to an intake vacuum pipe means 57 (FIG. 3) via a pipe 56.

A magnetic valve 58 is inserted into the intake vacuum pipe means 57, said magnetic valve 58 being connected by an injection control device 59 with a temperature transmitting means 60 and a starting information transmitting means 61 which measures positions K and L (1st gear and backward gear) of a gear system 62. A further transmitting means 63 is formed by a manually operable switch.

Figure 4:
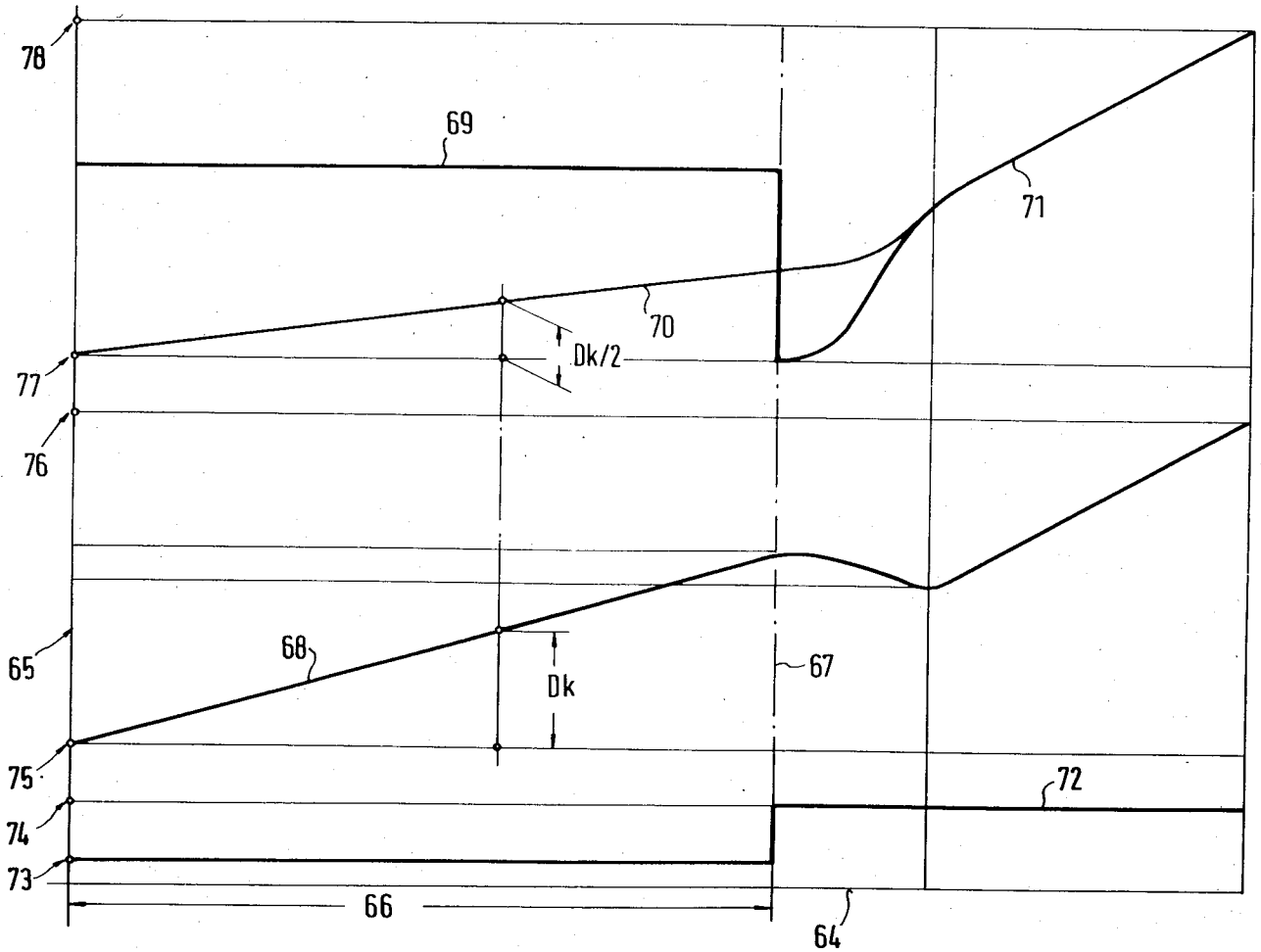
FIG. 4 is a diagram in which the fuel mixture or air feeding for both groups of cylinders is shown.

In FIG. 4, a fuel-air mixture or air feeding resulting from the actions of cam plate 9 or the radial cam 37 is shown by means of a control diagram. The gas pedal position is entered on the abscissa 64 and the positions of the throttle valve are entered on the ordinate 65.

A predetermined part-load range has the reference number 66; its end has number 67. A curve 68 shows the fuel-air feeding of the first cylinder group I in all operational phases of the internal-combustion engine. A curve 69 for the second cylinder group II shows the air supply in the case of a warmed-up internal-combustion engine. Another curve 70 shows the fuel-air feeding for the second cylinder group II when the radial cam 37, as a function of parameters, is in the operational position H. A curve 71 shows the fuel-air mixture feeding for the second cylinder group II in all operational ranges of the internal-combustion engine from the end 67 of the predetermined part-load range to full-load. A line 72 shows the fuel supply for the second cylinder group II in the case of a warmed-up internal-combustion engine.

On the ordinate 65, point 73 symbolizes the condition of the interrupted fuel supply; point 74 symbolizes the condition of the opened fuel supply for the second cylinder group II in the case of a warmed-up internal-combustion engine; point 75 symbolizes the position of the closed throttle valve 4; point 76 symbolizes the position of the fully opened throttle valve 4 of the first cylinder group I; point 77 symbolizes the theoretical position of the closed throttle valve 6 of the second cylinder group II and point 78 the position of the fully opened throttle valve 6. Reference is also made to DE-PS No. 30 44 248 discussed above.

According to curve 70, it is demonstrated that in the operational position H of the radial cam 37 (caused by the cam contour line 42), the second cylinder group II receives about half of the fuel-air mixture of the first cylinder group I which is achieved by a corresponding opening of the throttle valve 6. This is demonstrated by means of the comparison of Dk and Dk/2. The curve 70 also shows that the second cylinder group II operates without loss of torque.

The described device becomes effective in the following conditions: 1. The temperature transmitting means 60 reports the internal-engine has not reached its operational temperature. 2. The starting information transmitting means 61 reports that 1st gear or backward gear is in operation. 3. The manual switch transmitting means 61 is switched on (for example, for the trailing operation of trailers).

The injection control device 59 now transmits a signal to the magnetic valve 58 and opens it. As a result, the membrane 54 of the vacuum box 43 is acted upon by the intake pipe vacuum; the rod structure 53 actuates the bent levers 45, 46, and the radial cam 37 is moved into its operating position H. The second cylinder group II is now supplied with the fuel-air mixture in a predetermined part-load range in such a way that no noticeable loss of torque takes place that would result in a dying of the internal-combustion engine.

Although the invention has been described in detail with reference to a preferred embodiment and specific examples, variations and modifications exist within the scope and spirit of the invention as described and defined in the following claims.

What is claimed is:

1. In a motor vehicle having a transmission and a gas pedal, a multi-cylinder internal-combustion engine comprising:

at least two cylinder groups, each cylinder group having an intake pipe including a throttle valve attached to a throttle valve shaft; a control lever attached to each throttle valve shaft;

a cam plate connected to the gas pedal for interacting with the control levers to vary the positions of the throttle valves such that the first cylinder group throttle valve opens in a substantially direct relation to an increase in the gas pedal position whereas the opening of the second cylinder group throttle valve is delayed until the gas pedal passes a predetermined position; and an overriding means responsive to a selective input for overriding the position of the second cylinder group throttle valve such that when activated, said overriding means causes the second cylinder group throttle valve to open in relation to an increasing gas pedal position before the gas pedal reaches said predetermined position;

wherein said overriding means includes a radial cam attached to said cam plate for opening said second cylinder group throttle valve a sufficient distance to admit a quantity of a fuel-air mixture which is approximately one-half of the quantity admitted by the first cylinder group throttle valve.

2. The internal-combustion engine of claim 1, further comprising a temperature transmitting means for providing an input to activate the first means.

3. The internal-combustion engine of claim 1, further comprising a starting information transmitting means for providing an input to activate the first means.

4. The internal-combustion engine of claim 1, further comprising a manually operable transmitting means for providing an input to activate the first means.

5. The internal-combustion engine of claim 1, further comprising means for providing an input to activate the first means from at least one transmitting means of a group consisting of a temperature transmitting means, a starting information means, and a manually operable transmitting means.

6. The internal-combustion engine of claim 5, wherein said overriding means further includes an activating device for moving the radial cam from a rest position to an operational position.

7. The internal-combustion engine of claim 6, wherein the activating device includes a vacuum box having a magnetic valve for controlling the vacuum of the vacuum box.

8. The internal-combustion engine of claim 7, further comprising an injection control device for controlling the magnetic valve, the injection control device being connected to at least one of the temperature transmitting means, starting information transmitting means, and manually operable transmitting means.

9. The internal-combustion engine of claim 7, further comprising a transmission rod structure for connecting the vacuum box with the radial cam, the transmission rod structure including two bent levers.

10. The internal-combustion engine of claim 6, wherein the radial cam is disk-shaped and extends in an approximately parallel relation with the cam plate.

11. The internal-combustion engine of claim 10, further comprising a bearing journal which extends vertically with respect to the cam plate for pivotally supporting the radial cam and a spring means for yieldably urging the radial cam into said rest position.

12. Internal combustion engine as in claim 1 wherein, the cam plate includes radial countour surfaces for interacting with the control levers to vary the positions of the throttle valves; and wherein said overriding means includes a radial cam having a cam contour edge attached to said cam plate and an activating means for moving said radial cam from a rest position to an operational position, said cam contour edge in said operational position engaging into the radial contour surface of the cam plate.

13. In a motor vehicle having a transmission and a gas pedal, a multi-cylinder internal-combustion engine comprising:

at least two cylinder groups, each cylinder group having an intake pipe including a throttle valve attached to a throttle valve shaft;

a control lever attached to each throttle valve shaft;

a cam plate connected to the gas pedal for interacting with the control levers to vary the positions of the throttle valves such that the first cylinder group throttle valve opens in a substantially direct relation to an increase in the gas pedal position whereas the opening of the second cylinder group throttle valve is delayed until the gas pedal passes a predetermined position;

a radial cam attached to said cam plate;

an activating means movably coupled to said radial cam and being responsive to a selective input for overriding the position of said second cylinder group throttle valve such that when activated, said activating means causes said second cylinder group throttle valve to open in relation to an increasing gas pedal position before the gas pedal reaches said predetermined position, and a transmission rod structure having two bent levers for connecting said activating means with said radial cam.

14. The internal-combustion engine of claim 13, wherein the radial cam is arranged to open the second cylinder group throttle valve a sufficient distance to admit a quantity of a fuel-air mixture which is approximately one-half of the quantity admitted by the first cylinder group throttle valve.

15. The internal-combustion engine of claim 13, further comprising means for providing an input to activate the activating means from at least one transmitting means of a group consisting of a temperature transmitting means, a starting information means, and a manually operable transmitting means.

16. The internal-combustion engine of claim 15, wherein the activating device includes a vacuum box having a magnetic valve for controlling the vacuum of the vacuum box.

17. The internal-combustion engine of claim 16, further comprising an injection control device for controlling the magnetic valve, the injection control device being connected to at least one of the temperature transmitting means, starting information transmitting means, and manually operable transmitting means.

18. The internal-combustion engine of claim 17, wherein the radial cam is disk-shaped and extends in an approximately parallel relation with the cam plate.

19. The internal-combustion engine of claim 18, further comprising a bearing journal which extends vertically with respect to the cam plate for pivotally supporting the radial cam and a spring means for yieldably urging the radial cam into said rest position.

* * * * *